US005096055A

United States Patent [19]

Opper

[11] Patent Number: 5,096,055

[45] Date of Patent: Mar. 17, 1992

[54] DISPLAY CONTAINER

[75] Inventor: Tom S. Opper, Comstock Park, Mich.

[73] Assignee: DeWitt Packaging Corp., Grand Rapids, Mich.

[21] Appl. No.: 662,344

[22] Filed: Feb. 28, 1991

[51] Int. Cl.[5] ..... B65D 51/24

[52] U.S. Cl. ..... 206/45.13; 206/45.15; 206/804; 206/815; 229/164

[58] Field of Search ..... 206/45.13–45.19, 206/387, 804, 815; 229/117.13, 100, 126, 141, 149, 150, 164, 168, 198.2

[56] References Cited

U.S. PATENT DOCUMENTS

| | | | |
|---|---|---|---|
| 1,029,096 | 6/1912 | Wolf . | |
| 1,140,061 | 5/1915 | Pike . | |
| 1,410,763 | 3/1922 | Lambert . | |
| 1,556,074 | 10/1925 | Byrne . | |
| 2,370,967 | 3/1945 | Junkin . | |
| 2,375,843 | 5/1945 | Gottlieb | 206/45.29 |
| 2,550,968 | 5/1951 | Bussey . | |
| 3,900,100 | 8/1975 | Girman | 206/45.13 |
| 3,990,574 | 11/1976 | Roccaforte | 206/387 |
| 4,438,846 | 3/1984 | Stylianou . | |
| 4,519,655 | 5/1985 | Kampermann | 206/387 |
| 4,896,766 | 1/1990 | Paley | 206/45.15 |

FOREIGN PATENT DOCUMENTS

| | | | |
|---|---|---|---|
| 0469845 | 8/1937 | United Kingdom | 206/45.13 |

*Primary Examiner*—Jimmy G. Foster

*Attorney, Agent, or Firm*—Varnum, Riddering, Schmidt & Howlett

[57] ABSTRACT

A display and storage container is formed from a single blank and has a bottom wall, a pair of opposed side walls, and a pair of opposed end walls. A movable panel is hingedly mounted to one of the end walls and has a tongue extending therefrom which has a stop member at its free end. An inclined ramp is provided in the interior of the container so that when the lid is opened, an object disposed in the container for storage will be pulled by the stop member slidably upwardly on the inclined ramp toward a display position.

21 Claims, 5 Drawing Sheets

DISPLAY CONTAINER

BACKGROUND OF THE INVENTION

1. Field of the Invention

This invention relates to a display container, and more particularly, relates to a display container having a tongue which extends from a lid of the display container and is adapted to move an object to be displayed, such as a videocassette, along an inclined ramp to a display position from a concealed position inside the container.

2. Description of Related Art

Packaging displays in the form of boxes or containers are well known in the art and come in a variety of shapes, sizes and configurations. Conventionally, many such boxes or containers include a lid for securely enclosing the contents inside the container when not on display. A typical prior art construction is shown in FIG. 1 and is conveniently used to store or ship an object such as a videocassette. The box includes a bottom panel A, four side panels B, C, D, E, and an upper panel F parallel to the bottom panel A and disposed vertically above the bottom panel A. The box includes a recessed area for retaining the videocassette within the box, the recessed area being provided by cutting a generally rectangular area out of the center of the upper panel F and forming side flaps G, H which may be folded to extend downwardly toward the bottom panel A. A videocassette (not shown) may be placed within the recessed area, and when it is desired to remove the videocassette from the recessed area, a finger may be inserted within an aperture M so that the videocassette may be grasped. The aperture M is disposed in a portion of one side flap G and a portion of the upper panel F. The box includes a single panel lid I having two connecting tabs J adapted to be received within slots K provided in the upper panel F. The connecting tabs J are used to secure the lid I in a closed position when storing or shipping a videocassette within the container. An aperture N is provided in a portion of the upper panel F and a portion of the side panel B so that the lid I can be easily grasped and opened.

Although this type of prior art container provides an adequate enclosure for storing and shipping a videocassette, it suffers from significant shortcomings. Firstly, it is obvious that such a container lacks structure for readily presenting the videocassette in an inclined or display position. Furthermore, it is sometimes difficult to remove the videocassette from such a container because it is hard to grasp. Thirdly, if such a prior art container is designed with a larger recessed area to provide for easier retrieval of a videocassette therefrom, there is then an increased risk that the videocassette may be harmed during shipping because it is not firmly supported within the container.

The idea of providing a display box or container capable of alternately being folded into a closed position and displaying its contents in an inclined manner became known in the packaging industry quite some time ago. This concept enabled not only a container for shipping the goods but also a convenient way of displaying the goods after they were shipped to the retailer or customer. An example of such construction is the box disclosed in U.S. Pat. No. 1,140,061, issued May 18, 1915 to W. A. Pike, which is provided with a ledge extending around its perimeter and notches cut in the ledge. An interior container may be moved to an inclined position by placing its lower front edge in registry with the notches, thus securing the container and its contents in an inclined or display position.

A display box which automatically displays the contents of the box in an inclined position when the lid is opened is disclosed in U.S. Pat. No. 1,029,096, issued June 11, 1912 to O. A. Wolf, in which a movable bottom has a rear edge which can be raised by a collapsible support. A flexible strip connects the collapsible support to the lid of the display box so that when the lid of the display box is opened, the flexible strip causes the collapsible support to raise the movable bottom to an inclined position. The contents of the box which rest upon the top surface of the movable bottom are thereby raised to an inclined position.

For a long time, it has been widely recognized in the art that a display container is preferably formed from a single blank. Blanks can be economically and conveniently shipped and stored, thereby leaving setup of the blanks to the customer or packager. Blanks can be easily manufactured by die-cutting them from corrugated sheets. Box designers and engineers constantly strive to design the blanks so that the maximum number of blanks can be obtained from a given length of sheet, with minimum scrap. Conventional score lines or fold lines are often provided in a blank to assist in folding the blank to form a display box. An example of a display box formed from a single blank wherein the contents of the box can be displayed in an inclined position is shown in U.S. Pat. No. 1,410,763, issued Mar. 28, 1922 to R. A. Lambert.

There has been a need for a display container which can be used to ship and store goods as well as to present and display them to advantage. The container would most conveniently and effectively display the goods by placing them in an inclined position. Further, the container should provide for easy retrieval of the goods once they are displayed. Finally, and most importantly, the container should be capable of being formed from a single blank for purposes of convenience and economy. Such a container would provide a significant advance over prior art display containers.

SUMMARY OF THE INVENTION

The invention is directed to a container for displaying and storing an object. According to the invention, the container comprises a body which substantially defines an interior adapted to receive an object. An inclined ramp is disposed within the interior, and a movable panel is mounted on the body for movement relative to the body toward and from an open position. In the open position, the interior of the body is exposed. A tongue extends from the movable panel into the interior and has a stop member at a free end opposite the movable panel. Thus, when an object is disposed on the inclined ramp and in contact with the stop member, the stop member will urge the object slidably upwardly on the inclined ramp to a display position when the movable panel is moved toward the open position.

Preferably, the body, the inclined ramp, the movable panel, and the tongue are all formed from a single blank. Typically, the body comprises a bottom panel, a pair of opposed side walls, and a pair of opposed end walls, all cooperating to define the interior. The movable panel is preferably hingedly connected to one of the end walls.

In one aspect of the invention, the body comprises an upper panel substantially parallel to the bottom wall. The upper panel has a cutout portion, and the inclined ramp extends downwardly from the upper panel by way of the cutout portion toward the bottom panel. Preferably, the upper panel has a slot between the cutout portion and the end wall, and the tongue extends through the slot and between the inclined ramp and the bottom wall. Typically, the inclined ramp is integrally formed from the upper panel.

Also, the blank from which the container is formed will usually comprise corrugated paper board.

In another aspect of the invention, the stop member comprises a flap which is hingedly connected to and extending from the tongue. The flap has a small tab extending from its free end, and a large tab integral with the tongue and cut out of the flap. The large tab has a slot formed in it, and the flap is folded transversely at the cutout portion with the small tab being received in the slot. There is thereby formed a prism-like structure bounded in part on two sides by the flap and on the third side by the large tab.

In another aspect of the invention, a blank for forming a display and storage container comprises a plurality of panels. Adjacent panels are hingedly interconnected and the panels comprise a bottom panel, a pair of side panels extending from the bottom panel and spaced from one another for forming opposed side walls, a pair of end panels extending from the bottom panel and spaced from one another for forming opposed end walls, a movable panel extending from one of the end panels for forming a cover, and an upper panel extending from the other of the end panels. The movable panel has a tongue hingedly extending therefrom, and the upper panel has a cutout portion with a ramp formed from at least part of the cutout portion.

The upper panel typically has a slot adjacent the ramp which is dimensioned to receive the tongue when a container is erected from the blank. Preferably, the upper panel comprises a pair of side tabs spaced from one another and an end tab opposite one of the end panels. The side tabs and the end tab have a width less than the width of the side walls and the other of the end panels. When a container is erected from the blank, the side tabs will be adjacent the side walls and the end tab will be adjacent the end panel so that the upper panel will be recessed from the top edges of the one end wall and the side walls.

Preferably, the movable panel comprises a first panel hingedly connected to an end panel and a second panel extending from the first panel opposite the end panel. The second panel has a width not greater than the first panel and the tongue is hingedly extending from the second panel at a portion away from the edge of the second panel and in a direction away from the first panel. The tongue includes stop means at the free end thereof opposite the movable panel.

In another aspect of the invention, a rigidifying structure for corrugated containers comprises a panel, a flap hingedly extending from the panel, and a large tab integral with the panel and cut out of the flap. The flap has a small tab extending from an end thereof opposite the panel, and the large tab has a slot formed therein. The flap is folded transversely at the cutout portion and the small tab is received in the slot. There is thus formed a prism-like structure bounded in part on two sides by the flap and on the third side by the large tab.

BRIEF DESCRIPTION OF THE DRAWINGS

The invention will now be described with reference to the accompanying drawings in which.

DESCRIPTION OF THE PREFERRED EMBODIMENT

Figure 1:
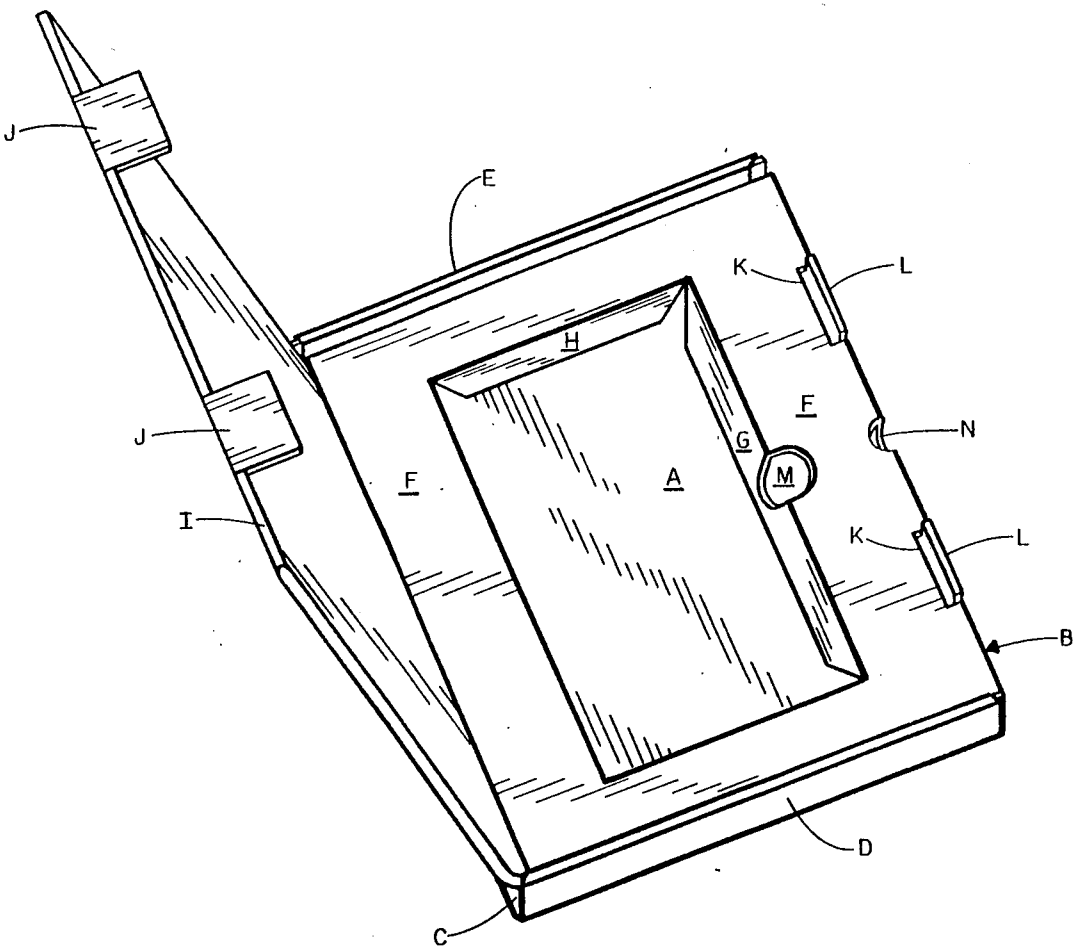
FIG. 1 (PRIOR ART)
FIG. 1 is a perspective view of a prior art container or box.

The principles of the invention may be understood, by way of example, with reference to a display container 10 and a blank therefor as shown in FIGS. 2–8. The display container 10 is particularly adapted for displaying a videocassette 11 as described in further detail below. The display container 10 is conveniently and economically formed from a single blank of corrugated paperboard. The present invention contemplates storing an object or contents within the display container in a closed or concealed position for purposes of shipping and storage. Provision is made for a quick and easy opening of the display container lid to an open position which causes the contents of the box to move to an inclined position for display purposes. It will be apparent to those skilled in the art after reading the description provided below that the present invention constitutes a significant advance over prior art display containers such as the prior art container shown in FIG. 1.

Figure 2:
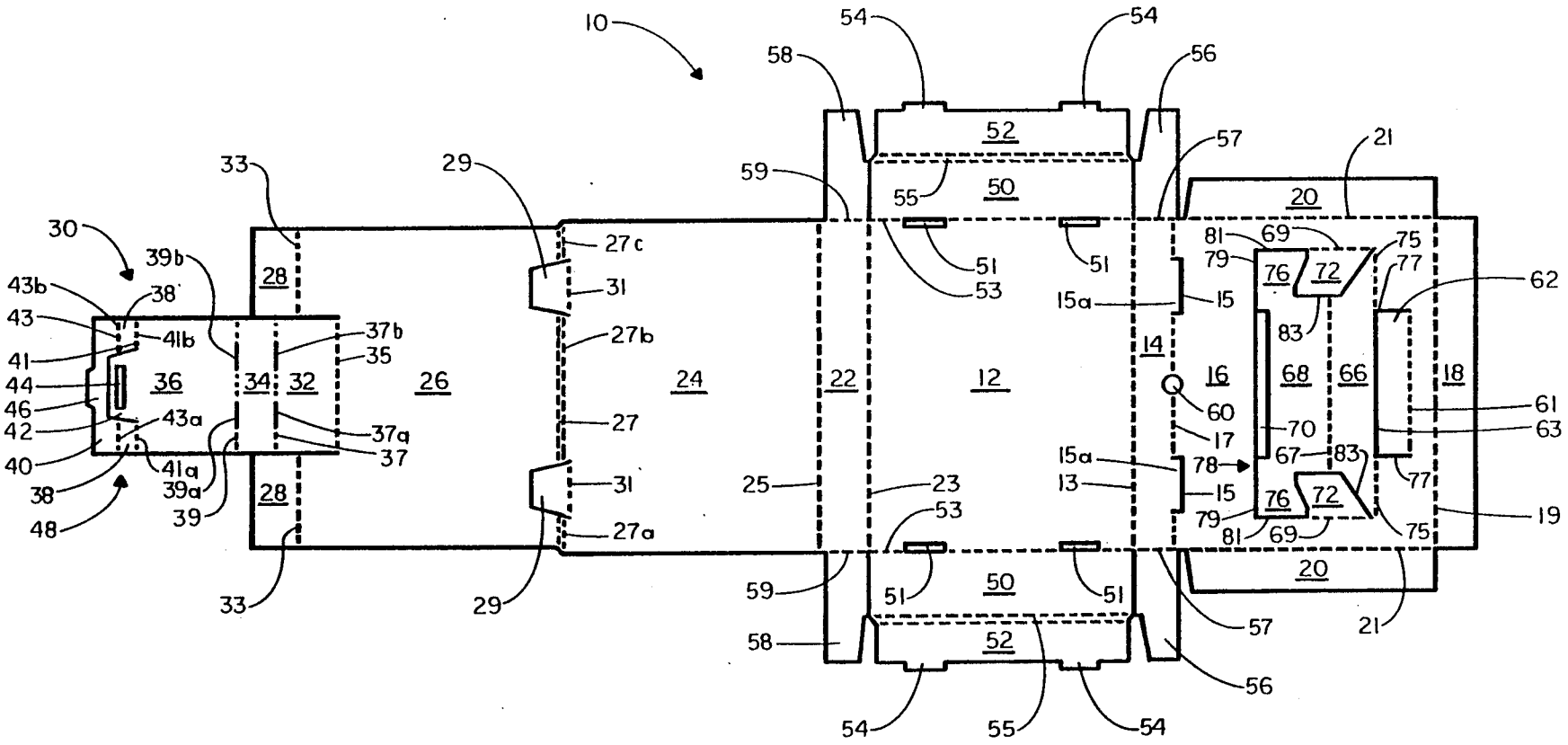
FIG. 2 is a plan view of a blank made according to the invention.

Referring specifically to FIG. 2, the display container 10 is shown in an unfolded condition. In other words, the unfolded display container 10 shown in FIG. 2 can be conventionally referred to as a single blank. As described in detail below, the blank shown in FIG. 2 can be folded and shaped according to the present invention to form the finished display container 10 shown in FIGS. 3–8. Referring again to FIG. 2, it will be seen that the display container 10 comprises a bottom panel 12 and a second panel 14 located adjacent the bottom panel 12 and separated from the bottom panel 12 by a score line 13. Similarly, a third panel 16 abuts the second panel 14 and is separated therefrom by a score line 17. However, two slots 15 are provided in the third panel 16 and are disposed along the score line 17. Two end flaps 15*a* are provided adjacent the slots 15. Also, a round aperture 60 is provided in the second panel 14 and the third panel 16 and is centrally located with respect to the score line 17.

An end panel 18 is disposed adjacent the third panel 16 but is disposed on the opposite side of the third panel 16 from the second panel 14. Score line 19 separates the end panel 18 from the third panel 16. The remaining two sides of the third panel 16 each have a fourth panel 20 adjacently located to them. Each fourth panel 20 is separated from the third panel 16 by a score line 21. The third panel 16 will be described in further detail below.

Continuing to refer to FIG. 2 and referring again to the bottom panel 12, a fifth panel 22 is located contiguous to the bottom panel 12 and is separated from the bottom panel 12 by a score line 23. The fifth panel 22 is disposed along the opposite side of the bottom panel 12 from the second panel 14. A sixth panel 24 abuts the fifth panel 22 and is separated therefrom by a score line 25. The sixth panel 24 is located on the opposite side of the fifth panel 22 from the bottom panel 12, or as viewed in FIG. 2, is located to the left of the bottom panel 12. A seventh panel 26 abuts along three segments 27*a*, 27*b*, 27*c* the sixth panel 24 on the side of the sixth panel 24 disposed opposite the fifth panel 22. Double score lines 27 separate the seventh panel 26 from the sixth panel 24 along the segments 27*a*, 27*b*, 27*c*. Upon inspection of FIG. 2, it can be seen that the double score lines 27 constitute two parallel score lines spaced apart from each other.

Slots are provided in the sixth panel 24 and seventh panel 26 to form two connecting tabs 29. The connecting tabs 29 are disposed between the segment 27*a* and the segment 27*b* and between the segment 27*b* and the segment 27*c*. The connecting tabs 29 are mounted to the sixth panel 24 along score lines 31. The connecting tabs 29 have trapezoidal shapes, and the score lines 31 are parallel to the double score lines 27 but spaced therefrom.

Outermost flaps 28 are located adjacent the seventh panel 26 and are disposed opposite the sixth panel 24. Score lines 33 separate the outermost flaps 28 from the seventh panel 26.

The seventh panel 26 has a tongue 30 mounted along a score line 35 which is parallel to the score lines 33 and the double score lines 27. As a consequence, the tongue 30 can rotate relative to the seventh panel 26 about the score line 35. The tongue 30 comprises a ninth panel 32, a tenth panel 34, an eleventh panel 36, two twelfth panels 38 and a thirteenth panel 40 which are side by side and located from right to left in FIG. 2. However, note that the two twelfth panels 38 are spaced from each other and one panel 38 is disposed above the other panel 38 as viewed in FIG. 2. The tongue 30 extends from an interior portion of the seventh panel 26, between the outermost flaps 28, and continues to extend away from the outermost flaps 28. Located adjacent the seventh panel 26 along the score line 35 is the ninth panel 32. A score line 37 separates the ninth panel 32 from the tenth panel 34 and includes two slots 37*a*, 37*b* disposed along it. A score line 39 separates the tenth panel 34 from the eleventh panel 36 and is identical to the score line 37, whereby slots 39*a*, 39*b* are formed along the score line 39. A score line 41 separates the eleventh panel 36 from the twelfth panels 38 along two segments 41*a*, 41*b*. Similarly, a score line 43 separates the twelfth panels 38 from the thirteenth panel 40 along two segments 43*a*, 43*b*. The twelfth panels 38 and the thirteenth panel 40 may be viewed as a single flap extending from the tongue 30.

A large tab or projection 42 is cut out from the twelfth panels 38 and the thirteenth panel 40. As viewed in FIG. 2, the projection 42 projects away from the eleventh panel 36 to the left. The projection 42 is disposed between the segment 41*a*and the segment 41*b* and is also disposed between the segment 43*a* and the segment 43*b*. In other words, the score line 43 extends transversely at the cutout portion and the flap is hingedly connected to the eleventh panel 36 free of the projection 42. The projection 42 has a rectangular aperture or slot 44 which is adapted to receive a small tab 46 which extends from the side of the thirteenth panel 40 opposite the twelfth panels 38.

Still referring to FIG. 2, it will be apparent that the panels 26, 24, 12 and 16 are spaced from each other along a horizontal axis which will be referred to as a longitudinal axis of the display container 10. A transverse axis of the display container 10 is defined as being perpendicular to the longitudinal axis. Thus, it can be seen that the panels 26, 24, 12 and 16 are spaced from each other longitudinally. It is also evident that the display container 10 is symmetrical about its central longitudinal axis.

Referring again to the bottom panel 12, two slots 51 are provided at each transverse end of the bottom panel 12 and are located adjacent a score line 53. Each score line 53 separates a fourteenth panel 50 from the bottom panel 12. A side panel 52 is located next to each fourteenth panel 50 and is separated therefrom by double score lines 55. Each side panel 52 includes two tabs 54 which extend transversely away from the side panel 52. The tabs 54 are adapted to be received within the slots 51 of the bottom panel 12.

Extending transversely from the second panel 14 and extending longitudinally from the fourteenth panel 50 is a flap 56 shaped in the nature of a foot. An identical flap 56 is disposed adjacent the opposing end of the second panel 14. Analogously, a flap 58 is disposed adjacent each longitudinal end of the fifth panel 22 and positioned next to the fourteenth panel 50.

Continuing to refer to FIG. 2 and referring again to the third panel 16, a transversely extending score line 61 is provided near the score line 19. The score line 61 separates a fifteenth panel 62 from the third panel 16. Disposed longitudinally inwardly of the fifteenth panel 62 is a seventeenth panel 66. A transversely extending slot 63 separates the fifteenth panel 62 from the seventeenth panel 66. A slot 77 extends longitudinally from each end of the score line 61 to each respective end of the slot 63. Thus, the fifteenth panel 62 is defined by the score line 61, the slot 63 and the slots 77.

Two score lines 75 extend transversely outwardly from respective ends of the slot 63. Thus, the score lines 75 and the slot 63 are generally linear. Since the fifteenth panel 62 is transversely smaller than the seventeenth panel 66, the score lines 75 serve to separate the seventeenth panel 66 from the third panel 16.

An eighteenth panel 68 is located at the opposing longitudinal end of the seventeenth panel 66 and is separated therefrom by a score line 67. The other longitudinal end of the eighteenth panel 68 includes a rectangular aperture 70 which preferably has a rectangular shape. The rectangular aperture 70 abuts the third panel 16 but is separated therefrom by a transversely extending cut 79. The rectangular aperture 70 is slightly longer in the transverse direction than the previously described tongue 30. Thus, the eighteenth panel 68 includes two portions 76 which extend transversely away from the rectangular aperture 70. The cut 79 separates a longitudinally inward side of each portion 76 from the third panel 16. A transversely outward side of each portion 76 is separated from the third panel 16 by a longitudinally extending cut 81.

Two cuts 83 are provided in the seventeenth panel 66 and the eighteenth panel 68 in the area of their transverse ends. These cuts 83 partially define two side flaps 72. The side flaps 72 are mounted to the third panel 16 along score lines 69. It will be apparent that the cuts 79, 81, 83 are colinear to define a cutout portion.

With this cutout portion, a unitary construction is formed and is disposed inwardly of the third panel 16. This unitary construction will be referred to as an inclined ramp portion 78 and comprises the panels 66, 68.

Figure 3:
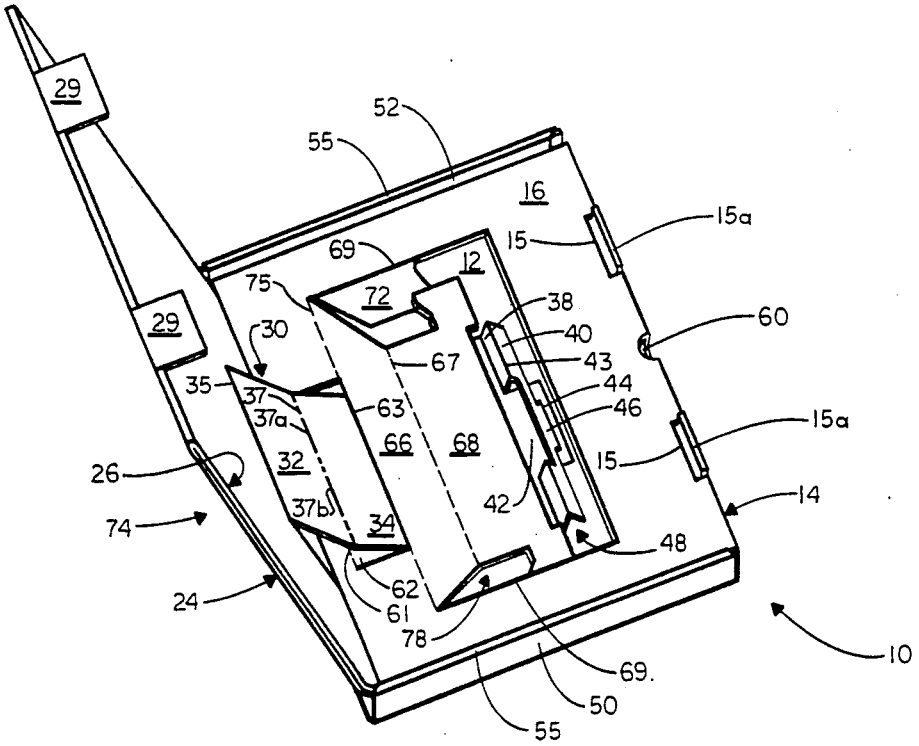
FIG. 3 is a perspective view of the blank of FIG. 2 formed into a display container according to the invention.

Turning now to FIGS. 2 and 3, the blank shown in FIG. 2 can be folded and shaped to take the form of the finished display container 10 shown in FIG. 3. The display container 10 can be formed by performing the following steps. First, referring back to FIG. 2, each of the flaps 56, 58 are folded longitudinally inwardly of the display container 10 along their respective score lines 57, 59. Next, the second panel 14 is folded along the score line 13. The second panel 14 is folded upwardly until it becomes perpendicular to the bottom panel 12. Thus, as is apparent from FIG. 2, each flap 56 is then positioned adjacent its corresponding slot 51. Similarly, the fifth panel 22 is then folded upwardly so that it rotates about the score line 23 until the fifth panel 22 is perpendicular to the bottom panel 12. It will be apparent that the second and fifth panels, 14 and 22, respectively, form end walls in the container. Thus, the flaps 58 will then be positioned adjacent their corresponding slots 51. Next, both of the fourteenth panels 50 are folded upwardly along their respective score lines 53 until each fourteenth panel 50 is perpendicular to the bottom panel 12. Therefore, in this position, the flaps 56, 58 will bear directly against the corresponding fourteenth panels 50. Then, the side panels 52 are folded along the double score lines 55 and are folded transversely inwardly until the tabs 54 are positioned adjacent the slots 51. The tabs 54 are then inserted into the slots 51. It will be apparent that each fourteenth panel 50 and associated side panel 52 together form a side wall of the container, there being a pair of opposed side walls.

Continuing to refer to FIG. 2, the seventh panel 26 can be folded longitudinally inwardly of the display container 10. The seventh panel 26 should be folded along the double score lines 27 until the seventh panel 26 abuts against the sixth panel 24, together forming a lid or cover for the container. Then, the outermost flaps 28 can be folded along the score lines 33 until the outermost flaps 28 bear against the fifth panel 22. The next step requires a folding of the tongue 30 about the score line 35 longitudinally outwardly of the display container 10 until the eleventh panel 36 of the tongue 30 extends vertically upwardly. While holding the tongue 30 in this manner, the fourth panels 20 should be folded along the score lines 21 until the fourth panels 20 are perpendicular to the third panel 16. In like manner, the end panel 18 should be folded along the score line 19 until the end panel 18 is also perpendicular with the third panel 16. Then, the third panel 16 should be folded along the score line 17 while folding the panels 18, 20 inwardly of the display container 10. The third panel 16 should be folded longitudinally inwardly until the third panel 16 becomes parallel to the bottom panel 12, thereby forming an upper panel spaced vertically above the bottom panel, but recessed slightly below the top edges of the side walls and the end wall formed by the fifth panel 22. In this position, the end panel 18 will abut the outermost flaps 28 and a portion of the fifth panel 22. The fourth panels 20 will bear directly against the side panels 52.

Next, the twelfth panels 38 can be folded relative to the eleventh panel 36 along segments 41*a*, 41*b* of the score line 41 while at the same time folding the thirteenth panel 40 relative to the twelfth panels 38 along segments 43*a*, 43*b* of the score line 43. The panels 38 and 40 should be folded in such a manner that the tab 46 extends through the rectangular aperture 44 as shown in FIG. 3, thus forming a rigidifying structure capable of serving as a stop 48. Referring back to FIG. 2, the fifteenth panel 62 should be bent downwardly along the score line 61 about 30°, thus exposing the slot 63.

Referring to FIGS. 2 and 3, the stop 48 can then be inserted into the slot 63 and pushed through the slot 63 until the tenth panel 34 of the tongue 30 is located adjacent to the slot 63. Next, the seventeenth panel 66 can be folded downwardly about the score lines 75 toward the bottom panel 12, the panels 66, 68 thereby forming an inclined ramp 78 within the interior of the container by way of the cutout portion. Then, the side flaps 72 (only one side flap 72 can be seen in FIG. 3) can be folded along the score lines 69 until the side flaps 72 are perpendicular to the bottom panel 12 and so that one edge of each side flap 72 bears against the bottom panel 12. Upon performing all of the above steps in the aforementioned sequence, the display container 10 will take the shape shown in FIG. 3.

Figure 4:
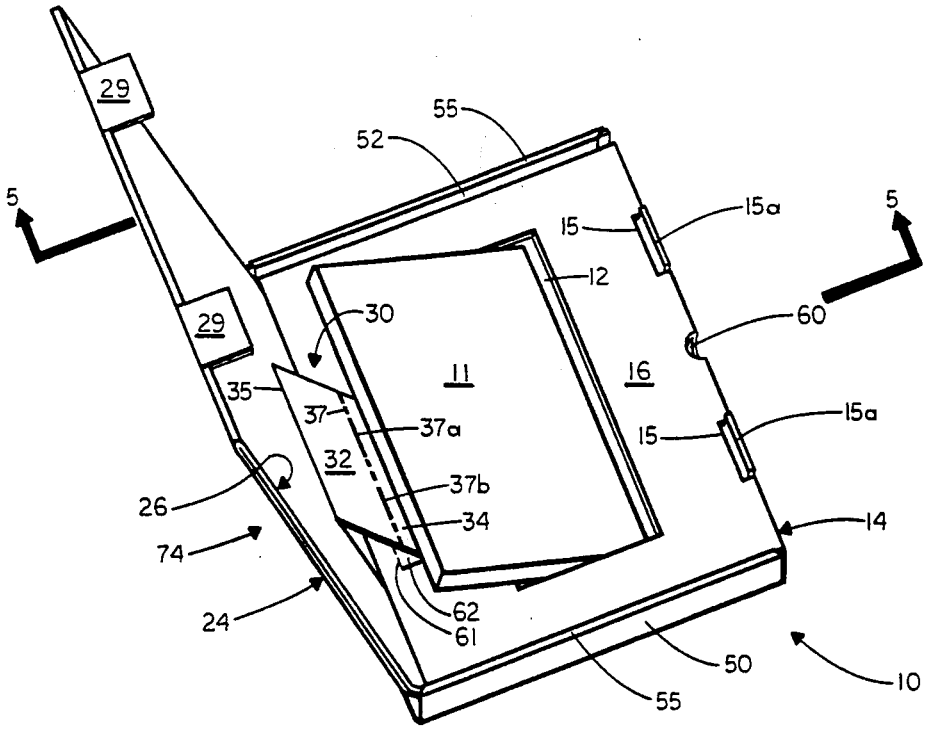
FIG. 4 is a perspective view of the display container of FIG. 3, but showing a videocassette supported in an inclined display position.
Figure 5:
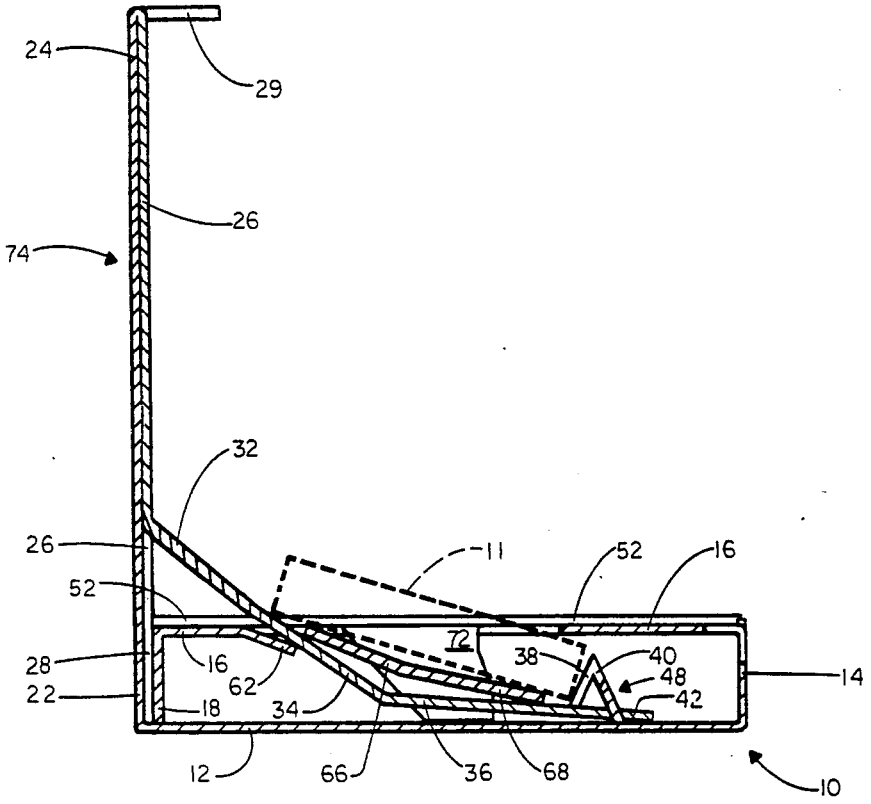
FIG. 5 is a sectional view of the display container of FIGS. 3 and 4 taken along line 5—5 of FIG. 4, a lid of the container being shown in an open position.

Referring to FIGS. 3, 4 and 5, the videocassette 11 (not shown in FIG. 3) can be placed so that portions of its bottom surface rest against the seventeenth panel 66 adjacent the score lines 75 and against the eighteenth panel 68 adjacent the rectangular aperture 70, including the portions 76. In addition, as viewed in FIG. 5, the lowermost edge of the videocassette 11 bears against the twelfth panels 38 of the stop 48.

Figure 6:
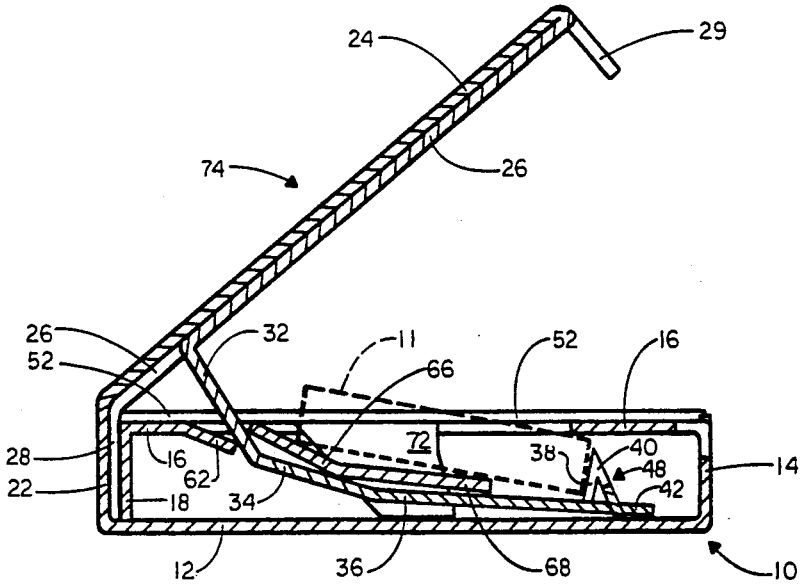
FIG. 6 is a view similar to that of FIG. 5, but showing the lid in a partially closed position.
Figure 7:
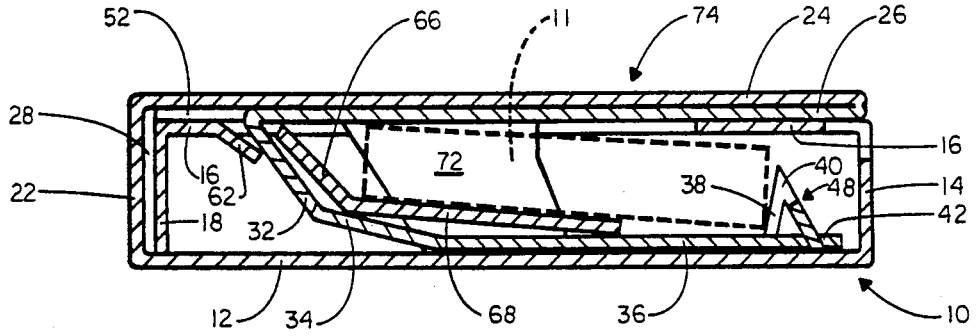
FIG. 7 is a view similar to that of FIG. 5, but showing the lid in a closed position.

Referring to FIGS. 4 and 5, the videocassette 11 is shown in an inclined or display position. A lid 74 of the display container 10 comprises the sixth panel 24 and the seventh panel 26 and is shown in the open position. With reference to FIG. 6, by folding the lid 74 toward the third panel 16, the stop 48 of the tongue 30 is caused to move in the direction of the second panel 14, when the stop 48 moves in the direction of the second panel 14, the videocassette 11 is free to descend the inclined ramp 78 by gravity as it also moves toward the second panel 14. As shown in FIG. 7, the videocassette 11 is substantially contained in the interior of the display container 10 once the lid 74 is closed. The lid 74 can be secured in the closed position by inserting the connecting tabs 29 (FIG. 3) into the slots 15 (FIG. 3) and then pushing the lid 74 downwards until the lid 74 is substantially parallel to the third panel 16. This position can be referred to as either the closed or the concealed position.

Figure 8:
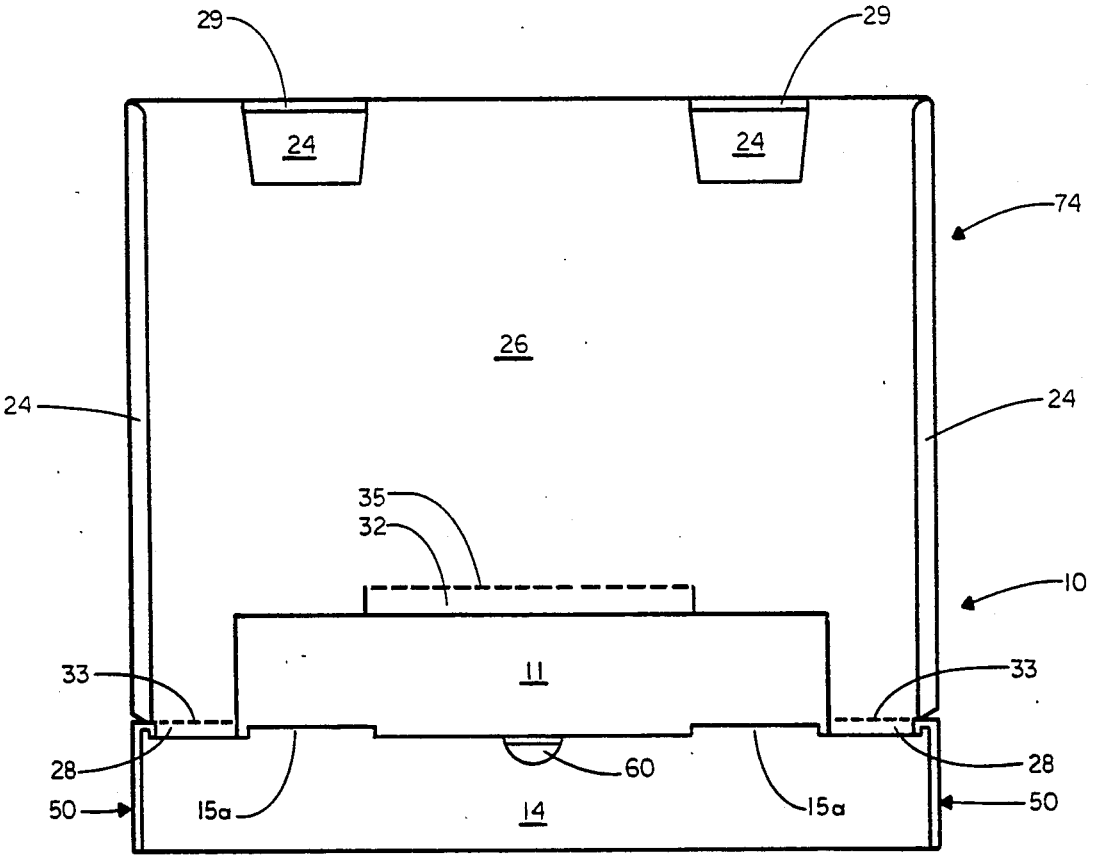
FIG. 8 is a front view of the display container of FIGS. 4 to 7 showing the lid of the container in an open position.

Referring to FIG. 8, the lid 74 can be moved away from the closed position toward the open position by inserting a finger inside the round aperture 60 and exerting an upward force on the seventh panel 26 of the lid 74 so that the connecting tabs 29 become disengaged from the slots 15. The lid 74 should be rotated until the display container 10 takes the shape shown in FIG. 4. As the lid 74 is moved away from the closed position toward the open position, the tongue 30 drags the stop 48 away from the second panel 14, thereby urging the videocassette 11 slidably upwardly on the inclined ramp toward the display position. Thus, it can easily be seen that the display container 10 provides a convenient means for moving a videocassette or other like object from a closed or concealed position to an inclined or display position merely by lifting the lid of the display container. In the display position, the videocassette is presented for easy grasping and removal from the container 10.

The principles of the invention are not limited to the specific display container 10 described herein nor to use with a videocassette. It will be apparent to those skilled in the art that modifications and variation of the above-described illustrative embodiment of the invention may be effected without departing from the spirit and scope of the novel concepts of the invention as defined in the appended claims.

The embodiments of the invention in which an exclusive property or privilege is claimed are defined as follows:

1. A container for displaying and storing an object, the container comprising:

a body substantially defining an interior adapted to receive an object;

an inclined ramp within the interior;

a movable panel mounted on the body for movement relative thereto toward and away from a closed position wherein the interior is enclosed; and a tongue extending from the movable panel into the interior, said tongue having a stop member at a free end thereof opposite the movable panel whereby when an object is disposed on the inclined ramp and in contact with the stop member, the stop member will urge the object slidably upwardly on the inclined ramp to a display position when the movable panel is moved away from the closed position.

2. A container according to claim 1 wherein the body, the inclined ramp, the movable panel and the tongue are formed from a single blank.

3. A container according to claim 2 wherein the body comprises a bottom panel, a pair of opposed side walls, and a pair of opposed end walls cooperating to define the interior.

4. A container according to claim 3 wherein the movable panel is hingedly connected to one of the end walls.

5. A container according to claim 4 wherein the body further comprises an upper panel substantially parallel to the bottom wall, said upper panel having a cutout portion, and the inclined ramp extends downwardly from the upper panel by way of the cutout portion toward the bottom panel and the other of the end walls.

6. A container according to claim 5 wherein the upper panel has a slot between the cutout portion and the one end wall, the tongue extending through the slot and between the inclined ramp and the bottom wall.

7. A container according to claim 6 wherein the inclined ramp is integrally formed from the upper panel.

8. A container according to claim 7 wherein the blank comprises corrugated paperboard.

9. A container according to claim 5 wherein the inclined ramp is integrally formed from the upper panel.

10. A container according to claim 1 wherein the body comprises a bottom panel, a pair of opposed side walls, and a pair of opposed end walls cooperating to define the interior.

11. A container according to claim 10 wherein the movable panel is hingedly connected to one of the end walls.

12. A container according to claim 10 wherein the body further comprises an upper panel substantially parallel to the bottom wall, said upper panel having a cutout portion, and the inclined ramp extends downwardly from the upper panel by way of the cutout portion toward the bottom panel and the other of the end walls.

13. A container according to claim 12 wherein the upper panel has a slot between the cutout portion and the one end wall, the tongue extending through the slot and between the inclined ramp and the bottom wall.

14. A container according to claim 1 wherein the stop member comprises a flap hingedly extending from the tongue, said flap having a small tab extending from the free end thereof, and a large tab integral with the tongue and cut out of the flap, said large tab having a slot formed therein, said flap being folded transversely at the cut out portion and said small tab being received in said slot, thereby forming a prism-like structure bounded in part on two sides by the flap and on the third side by the large tab.

15. A blank for forming a display and storage container comprising a plurality of panels, adjacent ones of the panels being hingedly interconnected, the panels comprising a bottom panel, a pair of side panels extending from the bottom panel and spaced from one another for forming opposed side walls, a pair of end panels extending from the bottom panel and spaced from one another for forming opposed end walls, a movable panel extending from one of the end panels for forming a cover, said movable panel having a tongue hingedly extending therefrom, and an upper panel extending from the other of the end panels, said upper panel having a cutout portion and a ramp formed from at least part of the cutout portion, wherein the upper panel has a slot adjacent to the ramp and dimensioned to receive the tongue when a container is erected from the blank.

16. A blank according to claim 15 wherein the upper panel comprises a pair of side tabs spaced from one another and an end tab opposite one of the end panels, said side tabs and said end tab having a width less than the width of the side walls and the other of said end panels, said side tabs being adapted to be adjacent to the side walls and the end tab being adapted to be adjacent to the one end panel when a container is erected from the blank whereby the upper panel will be recessed from the to edges of the one end wall and the side walls.

17. A blank according to claim 15 wherein the movable panel comprises a first panel hingedly connected to the one end panel and a second panel extending from the first panel opposite the one end panel, said second panel having a width not greater than the first panel, and said tongue hingedly extending from said second panel at a portion away from the edge of said second panel and in a direction away from the first panel.

18. A blank according to claim 15 wherein the tongue has stop means at the free end thereof opposite the movable panel.

19. A blank for forming a display and storage container comprising a plurality of panels, adjacent ones of the panels being hingedly interconnected, the panels comprising a bottom panel, a pair of side panels extending from the bottom panel and spaced from one another for forming opposed side walls, a pair of end panels extending from the bottom panel and spaced from one another for forming opposed end walls, a movable panel extending from one of the end panels for forming a cover, said movable panel having a tongue hingedly extending therefrom, and an upper panel extending from the other of the end panels, said upper panel having a cutout portion and a ramp formed from at least part of the cutout portion, wherein the tongue has stop means at the free end thereof opposite the movable panel, and wherein the stop means comprises a flap hingedly extending from the tongue, said flap having a small tab extending from the free end thereof, a large tab integral with the tongue and cut out of the flap, said large tab having a slot formed therein dimensioned to receive the small tab, an said flap being scored transversely at the cut out portion, whereby said flap can be folded and said small tab received in said slot when the stop means is erected from the blank.

20. A blank according to claim 15 wherein the panels are formed of corrugated paperboard.

21. A rigidifying structure for corrugated containers comprising a panel, a flap hingedly extending from the panel, said flap having a small tab extending from an end thereof opposite the panel, and a large tab integral with the panel and cut out of the flap, said large tab having a slot formed therein, said flap being folded transversely at the cut out portion and said small tab being received in said slot, thereby forming a prism-like structure bounded in part on two sides by the flap and on the third side by the large tab.

* * * * *